United States Patent [19]

Schremmer

[11] 4,303,171

[45] Dec. 1, 1981

[54] CONTAINER CLOSURES

[75] Inventor: Paul M. Schremmer, Hunters Hill, Australia

[73] Assignee: Aladdin Industries Pty. Limited, New South Wales, Australia

[21] Appl. No.: 172,638

[22] Filed: Jul. 25, 1980

[30] Foreign Application Priority Data

Aug. 3, 1979 [AU] Australia ..... PD9879

[51] Int. Cl.[3] ..... B65D 53/00

[52] U.S. Cl. ..... 220/238; 220/281

[58] Field of Search ..... 220/233, 234, 238, 256, 220/281

[56] References Cited

U.S. PATENT DOCUMENTS 4,083,468 4/1978 Batchelor ..... 220/238 X 4,254,889 3/1981 Jacobs ..... 220/238 X

*Primary Examiner*—George T. Hall

*Attorney, Agent, or Firm*—Steinberg & Raskin

[57] ABSTRACT

A closure member for an open-ended container having a resilient bottom closure member in which the outer edge thereof is sealable against the inside walls of the container. The closure member comprises a cam member attached to a pivotally mounted rocker which is adapted to act on the bottom closure member distorting it sufficiently to break the seal of the closure member against the inside wall of the container.

In another embodiment the closure member comprises a resilient bottom closure member in which the outer edge thereof is sealable against the inside walls of the container, and a flexible or resilient top closure member, wherein in one position of the flexible top closure member the bottom closure member is in sealable contact with the inside walls of the container, and wherein in another position of the flexible top closure member the bottom closure member is distorted sufficiently to break the seal of the closure member against the inside walls of the container.

6 Claims, 5 Drawing Figures

CONTAINER CLOSURES

The present invention relates to containers and container closures. The present invention especially relates to open-mouthed or open-ended storage containers for solid and liquid food substances having a closure arrangement which is easily operable and which provides an efficient seal for the container.

Multi-pieced container closures are known . One such closure comprises a resilient bottom closure member, the outer edge of which constitutes sealing means sealable against the inside walls of an open-mouthed container, a ridged top closure member interconnected with the bottom closure member, and an axially movable plunger extending through the top closure member and operable against the bottom closure member such that finger pressure applied to the top of the plunger is transmitted to the bottom closure member, distorting it sufficiently to break the seal of the closure against the inside wall of the container.

According to the known closure, the bottom closure member includes a biased area radially emanating from a central portion thereof to a peripheral terminus which, under pressure from the plunger, tends to collapse upon itself to displace the peripheral terminus, to allow the closure to be positioned in or removed from the open-mouthed container.

One of the problems with this type of closure is the relatively high pressure or force which is needed to be applied to the plunger in order to enable the closure to be positioned in or removed from the container, which can create problems in use for young children or some elderly people; it is essential with this type of closure that finger-pressure be maintained on the plunger at all times during the operations of removing or refitting the closure from or to the container.

It is an object of this invention to closures for open-mouthed containers which are both simple to operate and easy to use, as well as being more practical and of a more aesthetic design than prior art closures.

In one aspect the present invention provides a closure member for an open-ended container comprising a resilient bottom closure member in which the outer edge thereof constitutes sealing means sealable against the inside walls of said container, and a top closure member interconnected with said resilient bottom closure member, said top closure member including a central pivotally mounted rocker or toggle adapted to operate a downwardly extending cam member and said bottom closure member including a central upwardly extending buttress member adapted to cooperate with said cam member to impart an alternating movement in said bottom closure member from either a sealing position or an unsealed position, wherein in one position of said pivotally mounted rocker said sealing means of said resilient bottom closure member remain in sealable contact with the inside walls of said container and wherein in a second position of the pivotally mounted rocker said cam member acts on said buttress member to cause a downward movement of the buttress and to substantially uniformly displace said sealing means such that said closure member can be readily positioned in or removed from the open-ended container.

In another aspect of the present invention there is provided a closure member for an open-ended container comprising a resilient bottom closure member in which the outer edge thereof constitutes sealing means sealable against the inside walls of said container, and a flexible or resilient top closure member interconnected with said bottom closure member, said top closure member being convertible by flexing from a substantially convex profile to a substantially planar or slightly concave profile, and vice versa, on the application of a predetermined pressure, wherein in one said profile position of said top closure member said sealing means of said resilient bottom closure member remain in suitable contact with the inside walls of said container and wherein in the other said profile position of said top closure member said sealing means of said bottom closure member are substantially uniformly displaced such that said closure member can be readily positioned in or removed from the open-ended container.

Preferably the said sealing means are integral with the bottom closure member with said sealing means disposed about the peripheral edge of the bottom closure member. Such that said sealing means is closely juxtaposed, engageable and sealable against the inside walls of the container, to effectively hermetically seal the container. The components of the container closure are suitably manufactured from flexible plastics materials (such as polyethylene or polypropylene) such that in operation the outer peripheral diameter of the sealing means is contractable and distensible to allow the container to be sealed or unsealed as required. The components of the container closure may be molded by conventional compression or injection moulding techniques.

The invention will be further described by reference to drawings depicting various aspects of embodiments of the invention. In the drawings.

Figure 1:
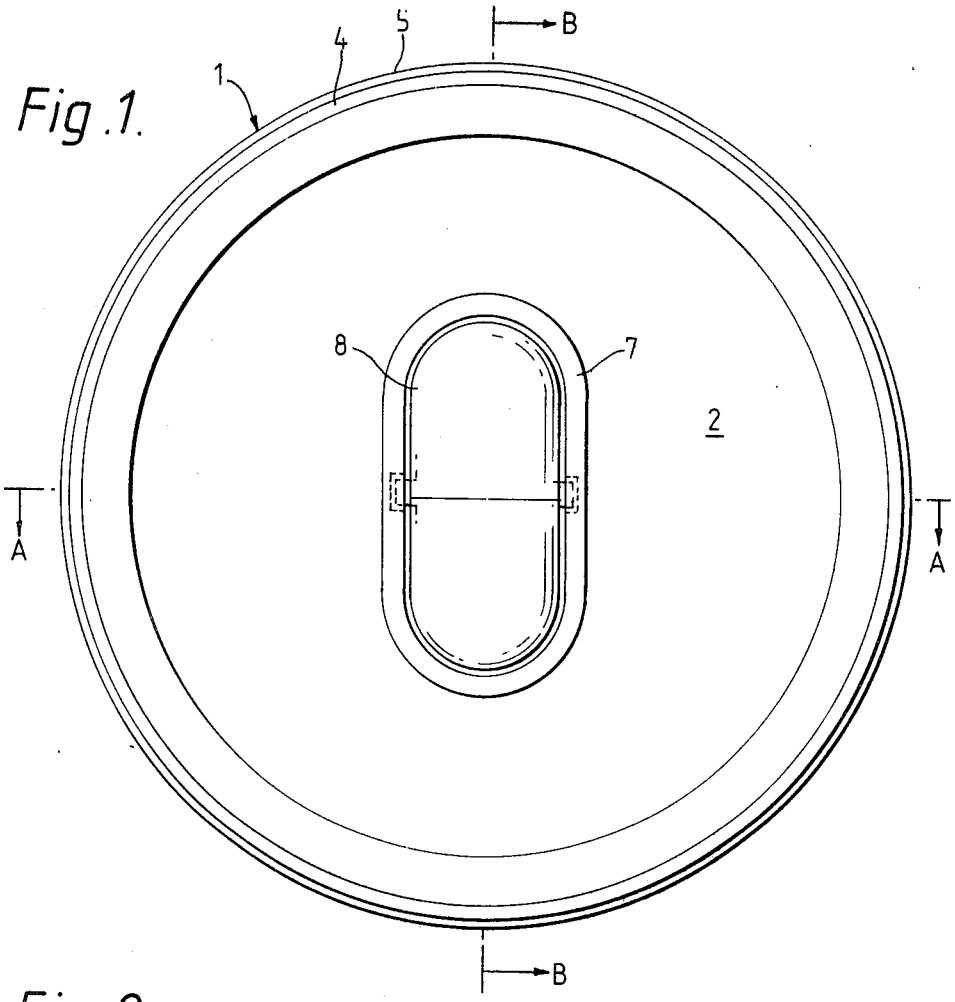
FIG. 1 is a top plan view of a container closure according to the present invention.

Referring to the drawings the closure member 1 comprises a top closure member 2 interconnected with a resilient bottom closure member or diaphragm 3 having integral side walls 4 and a peripheral sealing ring 5 sealable against the inner side walls of an open-ended container 6.

Figure 2:
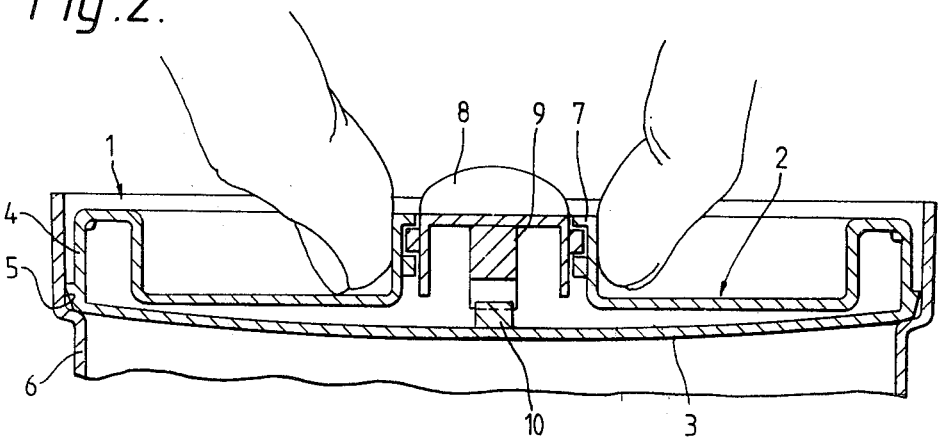
FIG. 2 is a sectioned elevational view of the closure of FIG. 1 taken along the line A—A.
Figure 3:
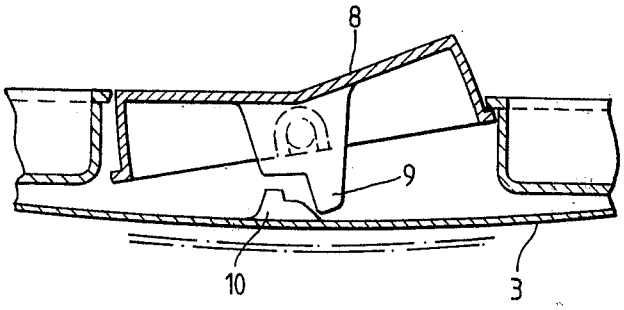
FIG. 3 is a sectioned elevational view of the closure of FIG. 1 taken along the line B—B.

The top closure member of FIGS. 1–3 is provided with a central upstanding, finger-grippable, bushing-like guide 7 housing a pivotally mounted rocker 8 adapted to operate a downwardly extending cam projection 9 to provide movement thereof in an arc.

The cam projection 9 is adapted to operate against the central portion of the bottom closure member 3. Preferably, and as illustrated in the embodiment illustrated in FIG. 3 the cam projection is adapted to operate against an upwardly extending buttress member 10 provided on the bottom closure member.

In the sealed position of the rocker 8, the cam projection 9 has little or no contact with either the bottom closure 3 member or the buttress member 10, and the resilient bottom closure member is then in the normal or fully distended position with the peripheral sealing ring 5 in sealing relationship with the inner side walls of the open-ended container 6. The inner side wall of the container may also be provided with inwardly protruding means, removed from the upper edge of the container wall, such that the sealing ring is positionable therebetween, said protruding means further providing an abutable surface against which the closure member is positionable to assure its proper placement within the container.

In the unsealed position of the rocker 8, the cam projection 9 is swung in the direction of an arc and extends substantially vertically downwards and is in hard contact with either the resilient bottom closure member or the buttress member 10 (FIG. 3). In other embodiments (not illustrated) the buttress member may be positioned in the bottom of a well 11 provided in the centre of the bottom closure member, which allows the use of a longer cam projection, resulting in increased diaphragm movement.

The action of the cam projection 9 on the buttress member 10 results in a downward movement of the buttress member with a resulting movement in the bottom closure member or diaphragm 3 to substantially uniformly displace the peripheral sealing ring 5 from its sealing relationship with the inner side walls of the open-ended container 6. In this position, the closure member is readily removable from, and capable of being readily positioned in, the open end of the container.

To seal the container the rocker 8 is switched from the unsealed to the sealed position wherein the cam projection 9 is moved out of contact with the bottom closure member or the buttress. Due to its inherent elastic memory, the bottom closure member then distends to its normal position with the sealing ring 5 in sealing relationship with the inner wall of the container 6. The movement of the cam projection either into or out of contact with the buttress member causes an audible sound, which some users may prefer as it is indicative of a positive change in either the sealed or the unsealed position of the rocker and of the closure member. However, is required, the audible sound can be reduced or eliminated by the use of a roller bearing on the end of the cam projection 9.

Figure 4:
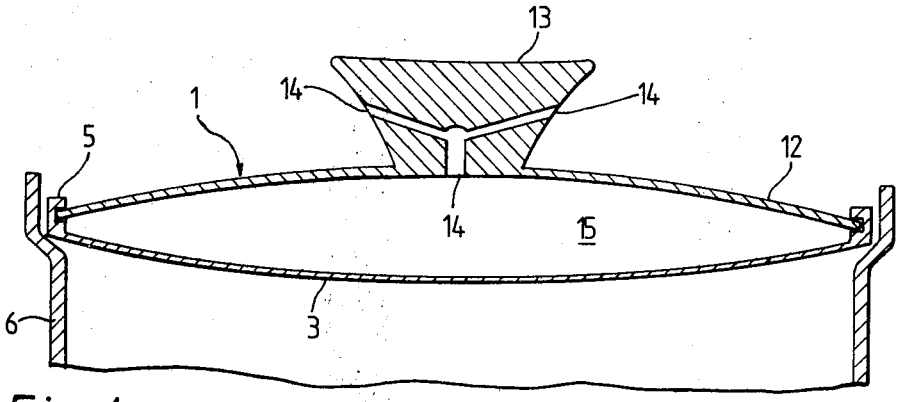
FIGS. 4 and 5 relate to another embodiment of the invention having a resilient top member convertible from substantially a convex profile to substantially a planar or slightly concave profile, and vice versa.
Figure 5:
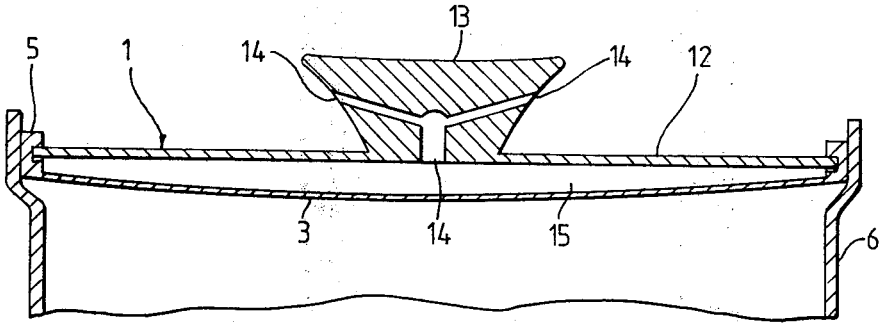

In FIGS. 4 and 5 is shown a further embodiment of the invention wherein the closure member comprises a flexible resilient top closure member 12 interconnected with a resilient bottom closure member or diaphragm 3. The flexible top closure member is convertible—by the application of a predetermined pressure—from a substantially convex profile (FIG. 4) to a substantially planar or slightly concave profile (FIG. 5), and vice versa.

The top closure member includes a flanged or finger-grippable upstanding central bush 13 which, in this embodiment, is provided with an air passageway or breather 14 leading from the central space 15 between the top and bottom closure members 12 and 3.

In the unsealed position of the closure (FIG. 4) the top closure member has a convex profile in which a concave profile is imparted to the diaphragm or bottom closure member 3; in other words, the diaphragm tends to collapse upon itself. In this position the peripheral sealing ring 5 is substantially uniformly displaced from its sealing relationship with the inner side walls of the open-ended container 6. In this position the closure may be readily inserted into or removed from the open mouth of the container 6.

After the closure is seated in the open mouth of the container, the latter can be sealed by the application of finger pressure to the top of the central bush 13. At this stage the top closure member flexes or collapses from its essentially convex profile (FIG. 4) to a planar or slightly concave profile as shown in FIG. 5. In this latter position the bottom closure member more or less has its normal or fully distended position with the peripheral sealing ring 5 forced radially outwards into sealing relationship with the adjacent inner side walls of the container 6.

To unseal the container, finger-pull pressure is applied to the central bush 13, pulling the bush vertically upwards. The upper closure member flexes and assumes the concave profile illustrated in FIG. 4.

Although the invention has been described above with reference to preferred embodiments and drawings, it will be appreciated that numerous variations, modifications or alternatives may be substituted for specifically described features, without departing from the spirit or scope of the invention as broadly described.

I claim:

1. A closure member for an open-ended container comprising a resilient bottom closure member in which the outer edge thereof constitutes sealing means sealable against the inside wall of said container, and a top closure member interconnected with said resilient bottom closure member, said top closure member including a central pivotally mounted rocker or toggle adapted to operate a downwardly extending cam member and said bottom closure member including a central upwardly extending buttress member adapted to cooperate with said cam member to impart an alternating movement in said closure member from either a sealing position or an unsealed position, wherein in one position of said pivotally mounted rocker said sealing means of said resilient bottom closure member remain in sealable contact with the inside walls of said container and wherein in a second position of the pivotally mounted rocker said cam member acts on said buttress member to cause a downward movement of the buttress and to substantially uniformly displace said sealing means such that said closure member can be readily positioned in or removed from the open-ended container.

2. A closure member according to claim 1 wherein said sealing means are integral with the bottom closure member, with said sealing means disposed about the peripheral edge of the bottom closure member.

3. A closure member according to claim 1 or claim 2, wherein said buttress member is positioned in the bottom of a well depression provided in the centre of the bottom closure member.

4. A closure member according to claim 1, wherein the lower end of the downwardly extending cam member is provided with a roller bearing adpated to cooperate with said buttress member.

5. In combination a container and closure member according to claim 1 wherein said container includes a projecting wall construction forming the open end thereof, and wherein said closure member is engageable with an sealable against said projecting wall.

6. The combination according to claim 5 wherein said projecting wall also includes inwardly protruding means removed from the upper edge thereof such that said sealing means is positionable therebetween, said protruding means further providing an abutable surface against which said closure member is positionable to assure its proper placement within the container.

* * * * *